US007690051B2

(12) United States Patent
Uchida et al.

(10) Patent No.: US 7,690,051 B2
(45) Date of Patent: Apr. 6, 2010

(54) HARNESS TYPE SAFETY BELT

(75) Inventors: Mitsuya Uchida, Tokyo (JP); Satoshi Teranishi, Tokyo (JP); Keiji Hara, Tokyo (JP); Tsuyoshi Kageyama, Tokyo (JP)

(73) Assignee: Prop Co., Ltd., Tokyo (JP)

( * ) Notice: Subject to any disclaimer, the term of this patent is extended or adjusted under 35 U.S.C. 154(b) by 139 days.

(21) Appl. No.: 11/818,000

(22) PCT Filed: Mar. 11, 2005

(86) PCT No.: PCT/JP2005/004366

§ 371 (c)(1),
(2), (4) Date: Sep. 7, 2007

(87) PCT Pub. No.: WO2006/095440

PCT Pub. Date: Sep. 14, 2006

(65) Prior Publication Data

US 2009/0019623 A1 Jan. 22, 2009

(51) Int. Cl.
*A41D 13/00* (2006.01)

(52) U.S. Cl. ..... 2/69

(58) Field of Classification Search ..... 2/455, 2/69, 456, 459, 16, 22, 24, 338, 102, DIG. 3
See application file for complete search history.

(56) References Cited

U.S. PATENT DOCUMENTS 5,500,952 A * 3/1996 Keyes ..... 2/465
5,781,936 A * 7/1998 Alaloof ..... 2/456
6,859,939 B1 * 3/2005 Osburn, Sr. ..... 2/69
6,942,630 B2 * 9/2005 Behan ..... 602/19

FOREIGN PATENT DOCUMENTS

| | | |
|---|---|---|
| DE | 10101039 | 11/2001 |
| JP | 05-003928 | 1/1993 |
| JP | 3015269 | 6/1995 |
| JP | 07-096049 | 11/1995 |
| JP | 11-333013 | 7/1999 |
| JP | 2003-265638 | 9/2003 |
| JP | 2004-321487 | 11/2004 |

* cited by examiner

*Primary Examiner*—Tejash Patel
(74) *Attorney, Agent, or Firm*—Lowe Hauptman Ham & Berner LLP

(57) ABSTRACT

A harness type safety belt absorbs dropping shocks to a user who accidentally falls from an elevated position. If the user fails to apply a rope hook to a life line and falls from the elevated position, an air bag in a mounting body inflates to absorb the dropping shock to reduce the dropping impact applied to the user. If the user falls with the rope hook connected to the life line, the rope suspends the user. The body of the user is supported by a waist belt, shoulder belts and thigh belts. Therefore a tension applied by the rope to the body of the user is dispersed to each of the belts so the body of the user is stably supported.

12 Claims, 11 Drawing Sheets

HARNESS TYPE SAFETY BELT

RELATED APPLICATION

The present application is based on, and claims priority from, PCT Application Number JP05/004366, filed Mar. 11, 2005, the disclosure of which is hereby incorporated by reference herein in its entirety.

TECHNICAL FIELD

The present invention relates to a harness type safety belt mainly used in an elevated work place such as a construction site.

BACKGROUND ART

In general, for the work in an elevated position such as a construction site, workers are obligated to wear a safety belt for preventing a fall. That type of safety belt includes a torso belt mounted in a torso part of the body of a user and a rope with predetermined length connected to the torso belt. A holding hook attached to the tip of the rope is generally applied to a main rope and the like at the working site.

However, the above described safety belt is mounted in the torso part of the body of the user. Therefore, a tension applied from the rope is concentrated in the torso part and the posture being suspended is apt to get unstable. Therefore, a so-called harness type safety belt (see Patent Document 1, for example) is known. That belt includes belts extending over not only the torso part of the body of the user but also both shoulders, a back and thigh parts of the user. By connecting a rope to the belt of the back, a tension applied from the rope to the body of the user is dispersed to the belts so as to stably support the body of the user.

In addition, even if the above described safety belt is used, safety measures was not perfect because an accidental fall occasionally takes place in such a case that the user fails to apply the hook of the safety belt to a main rope and the like or at an occasion of applying the hook to another place. Therefore, as a shock absorbing aid for absorbing a dropping impact at a fall, a dropping shock absorbing aid is known (see Patent Document 2, for example). That dropping shock absorbing aid includes a mounting body mounted on the body of a user, an air bag provided in the mounting body so as to correspond with a predetermined site of the body of the user and inflating means for inflating the air bag, wherein detection of a fall of the body of the user inflates the air bag with the inflating means.

However, in the above described dropping shock absorbing aid, the mounting body including a plurality of air bags is formed in the shape of a jacket. Therefore, when a harness type safety belt is worn over the mounting body, the belts of the safety belt prevent the air bags from being inflated. In the case of wearing the mounting body over the harness type safety belt, a rope connecting part provided in the back of the safety belt is covered by the mounting body, resulting in that no rope can be connected thereto. Consequently, there gives rise to a problem that concurrent use of the dropping shock absorbing aid and the harness type safety belt is difficult.

Patent Document 2: Japanese Patent Publication 11-333013
Patent Document 1: Japanese Patent Publication 7-96049

DISCLOSURE OF THE INVENTION

Problems to be Solved by the Invention

The present invention has been attained in view of the above described problems and an object thereof is to provide a harness type safety belt capable of absorbing a dropping shock to a user even if the user accidentally falls from an elevated position.

Means for Solving the Problems

In order to attain the object of the present invention, a harness type safety belt comprising a pair of shoulder part belts which intersect on a back of the body of a user and are hung on both shoulders; a pair of annular thigh part belts into which both thigh parts of the body of the user are inserted respectively; a waist part belt mounted on a waist part of the body of the user; and a connection part capable of connecting a rope to an intersecting part of the shoulder part belts comprises an air bag provided in a predetermined position of the belts; inflation means for inflating the air bag; fall detection means for detecting a fall of the body of the user; and control means for inflating the air bag when the fall detection means detects a fall of the body of the user. Thereby, in the case where the user accidentally falls from an elevated position, the air bag fitted to a mounting body is inflated. Thereby the air bag absorbs a dropping shock. In addition, in the case where the user is suspended by the rope connected to the connection part, the body of the user is supported by not only the waist part belt but also the shoulder part belts and the thigh part belts. Therefore a tension applied from the rope to the body of the user can be dispersed to each of the belts and the body of the user is stably supported.

Advantages of the Invention

The harness type safety belt of the present invention can absorb a dropping shock with the air bag in the case where a user falls from an elevated position in such a case that the user fails to apply the hook of a rope to a life line. Therefore, the dropping impact applied to the user can be reduced. In addition, in the case where the user is suspended by the rope, the body of the user can be supported by not only the waist part belt of the mounting body but also the shoulder part belts and the thigh part belts. Therefore a tension applied from the rope to the body of the user can be dispersed to each of the belts and the body of the user can be stably supported.

DESCRIPTION OF SYMBOLS

Figure 1:
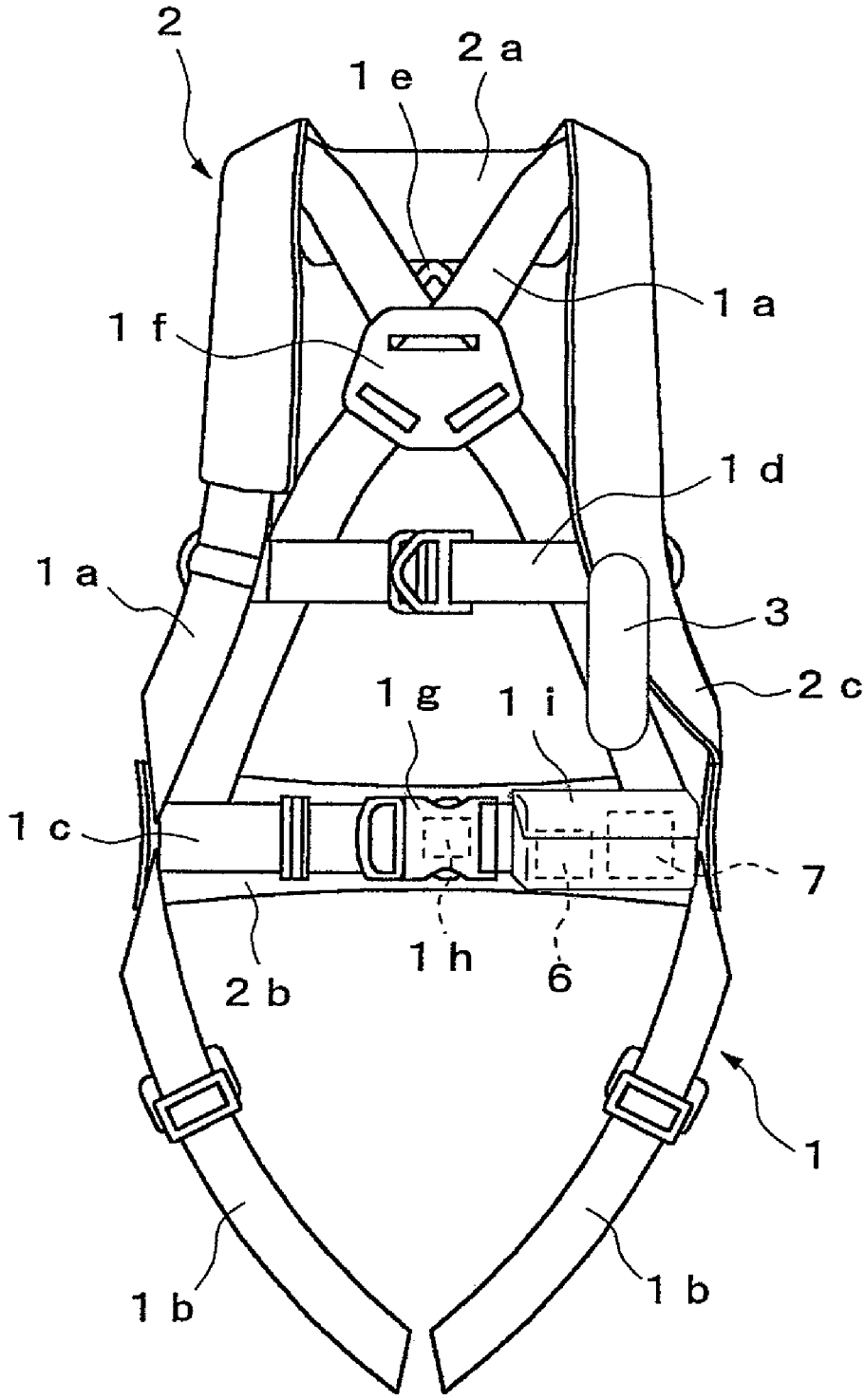
FIG. 1 is a front view of a harness type safety belt illustrating an embodiment of the present invention.
Figure 2:
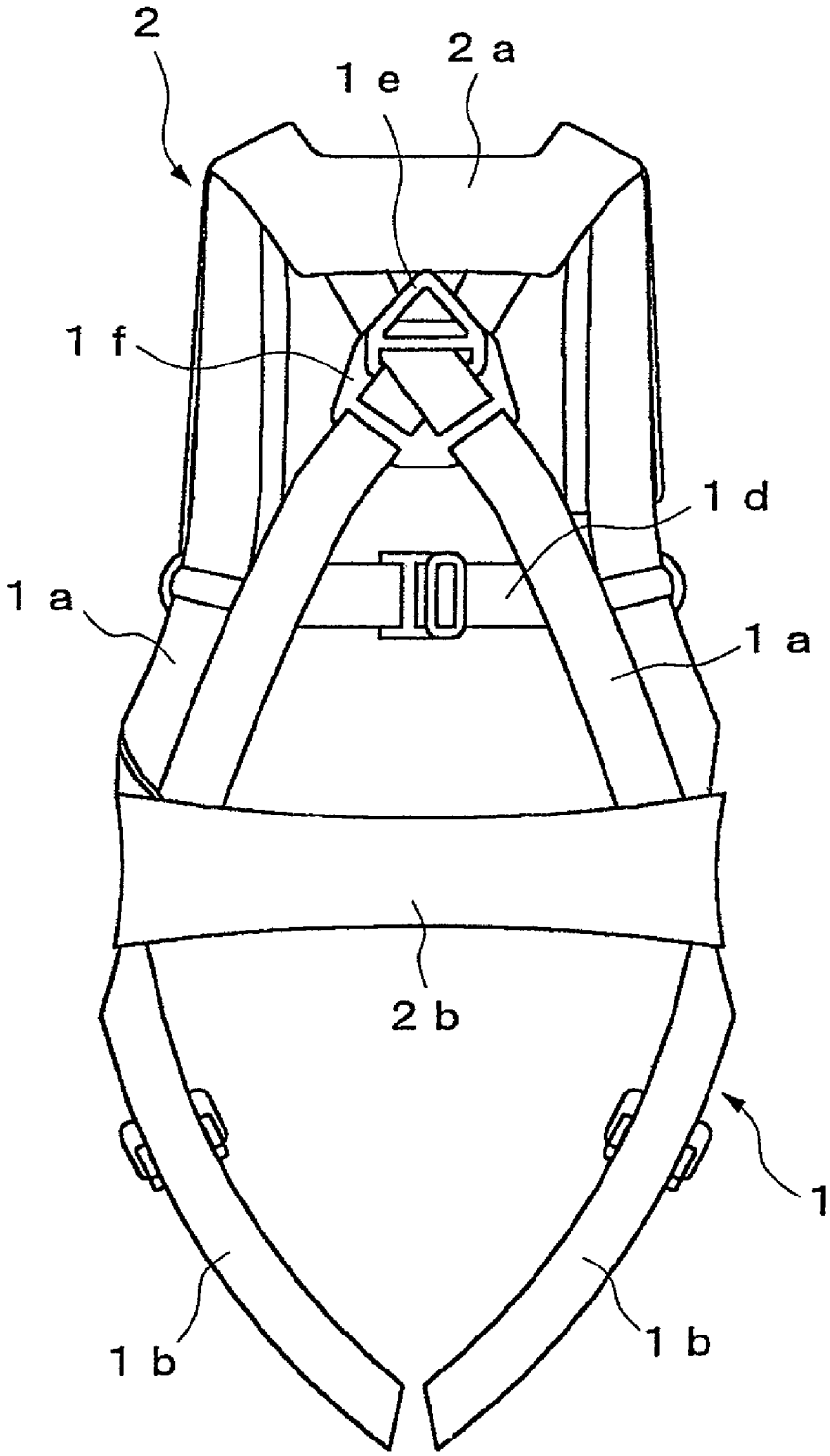
FIG. 2 is a rear view of a harness type safety belt.
Figure 3:
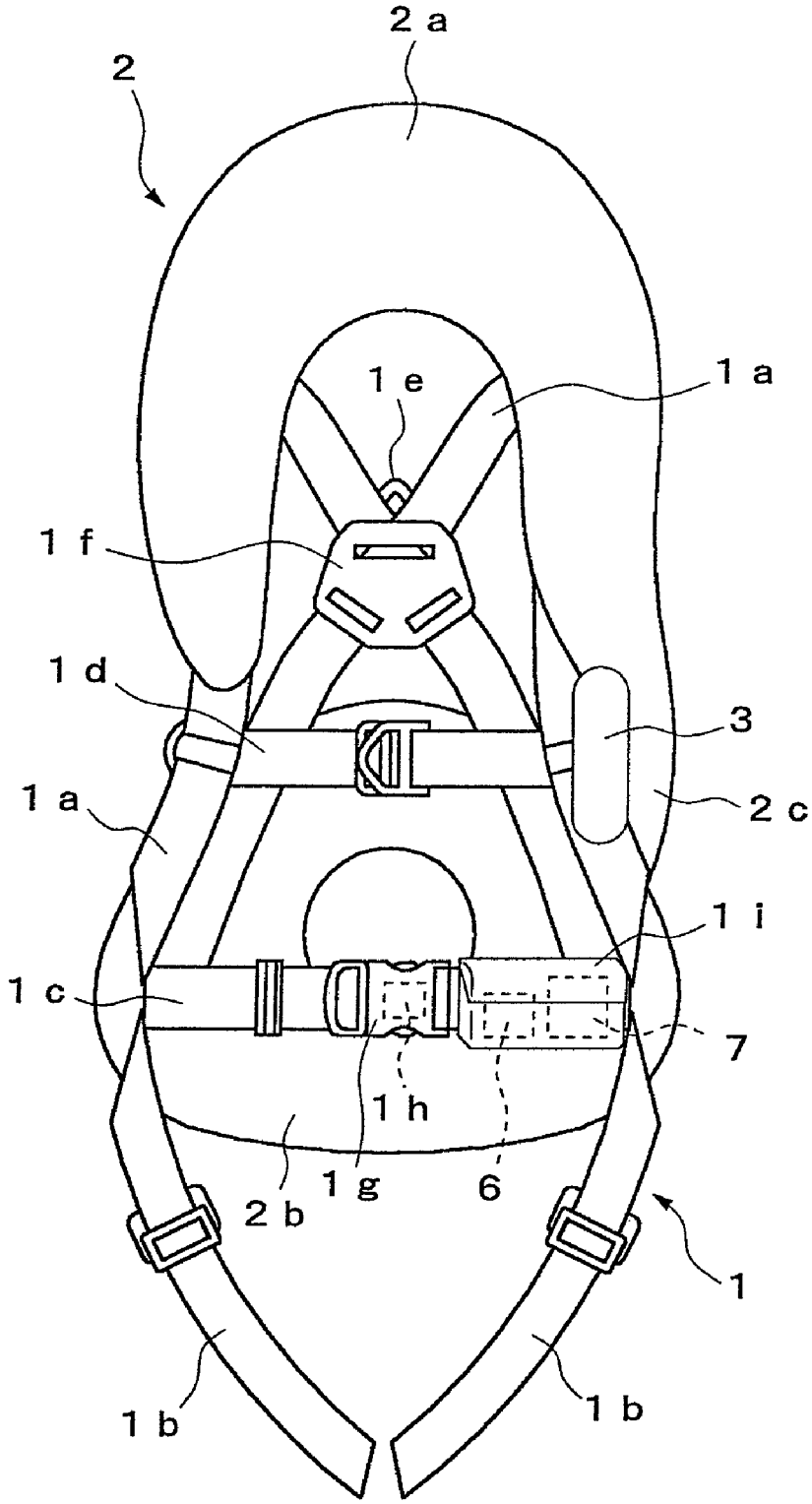
FIG. 3 is a front view illustrating an inflated state of an air bag.
Figure 4:
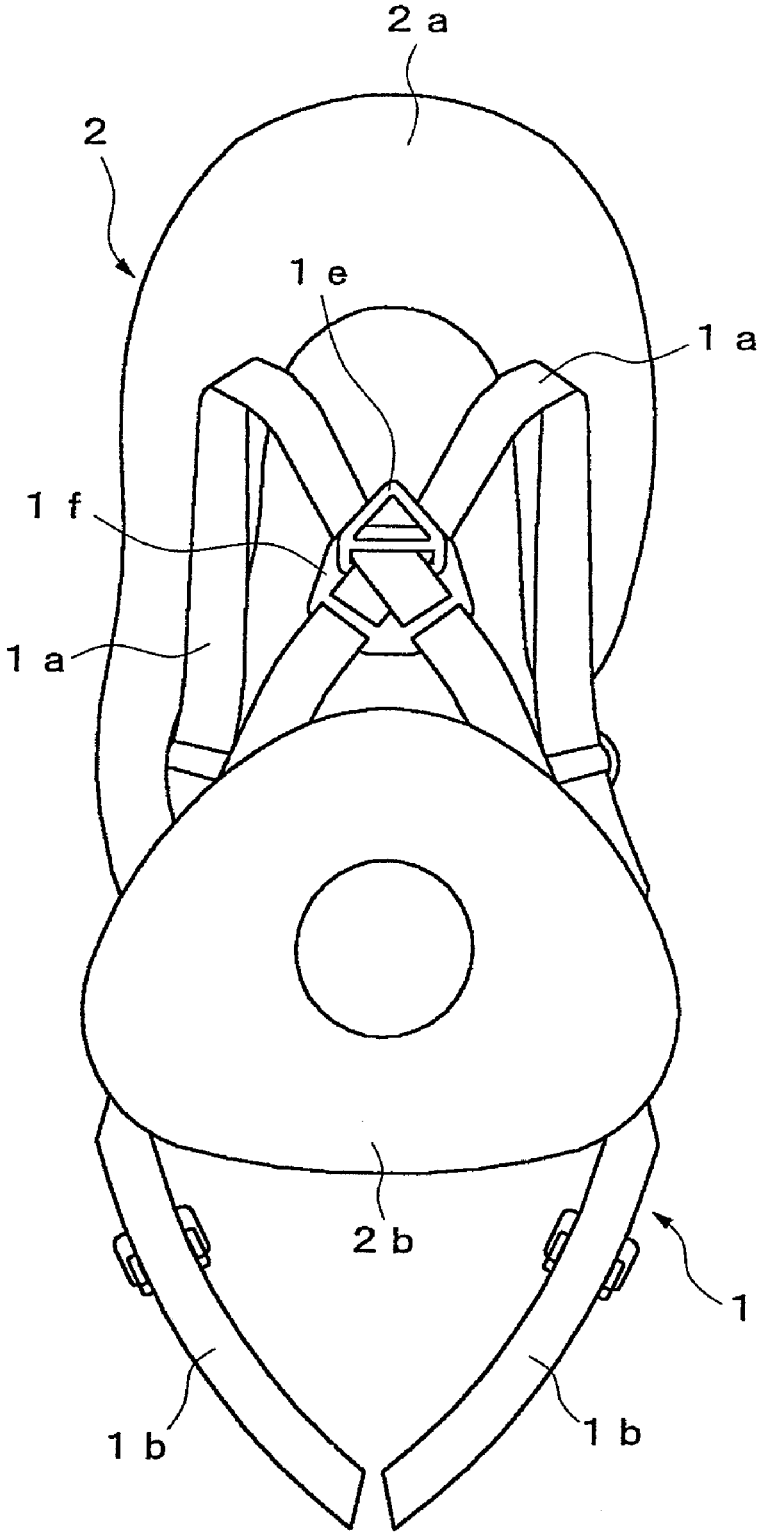
FIG. 4 is a rear view illustrating an inflated state of the air bag.
Figure 5:
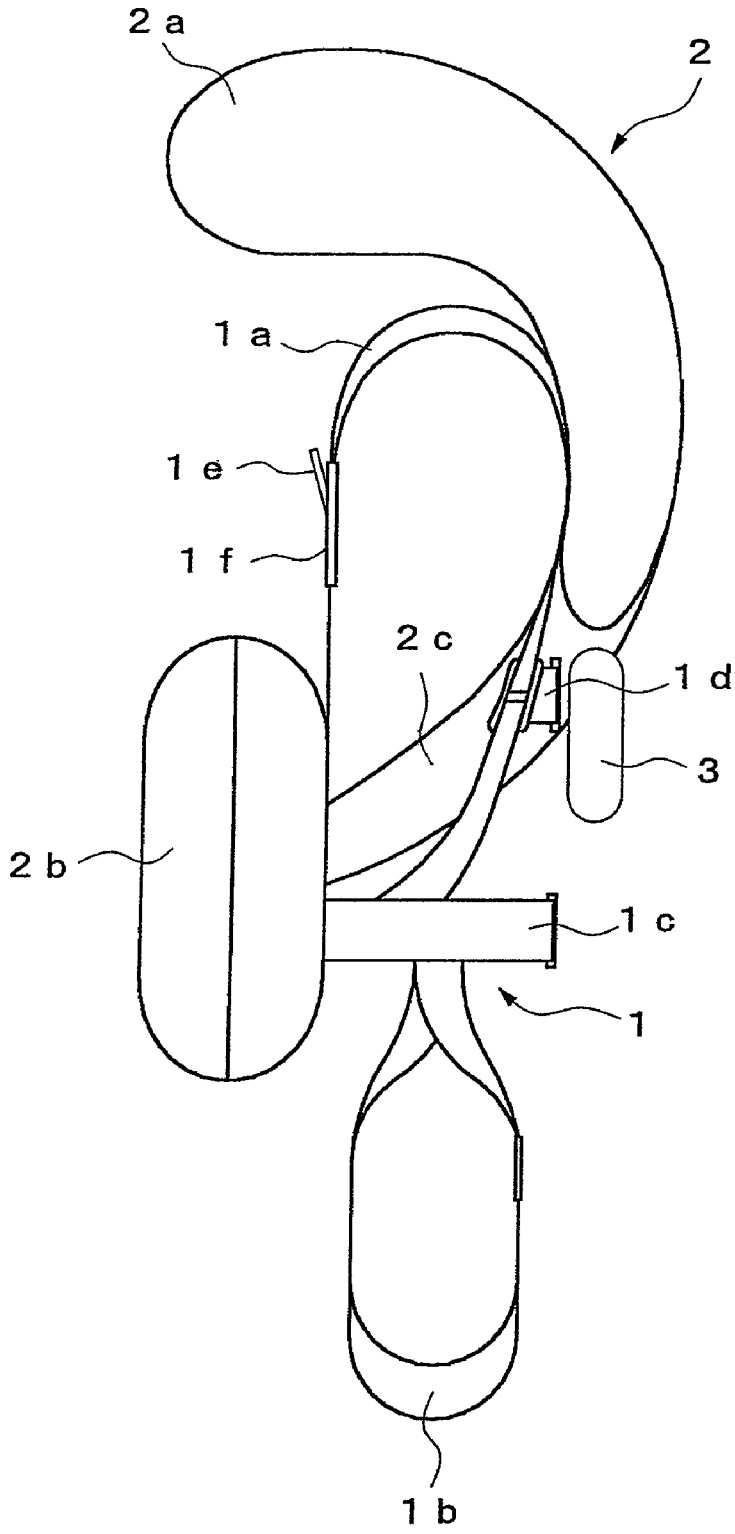
FIG. 5 is a left side view illustrating an inflated state of the air bag.
Figure 6:
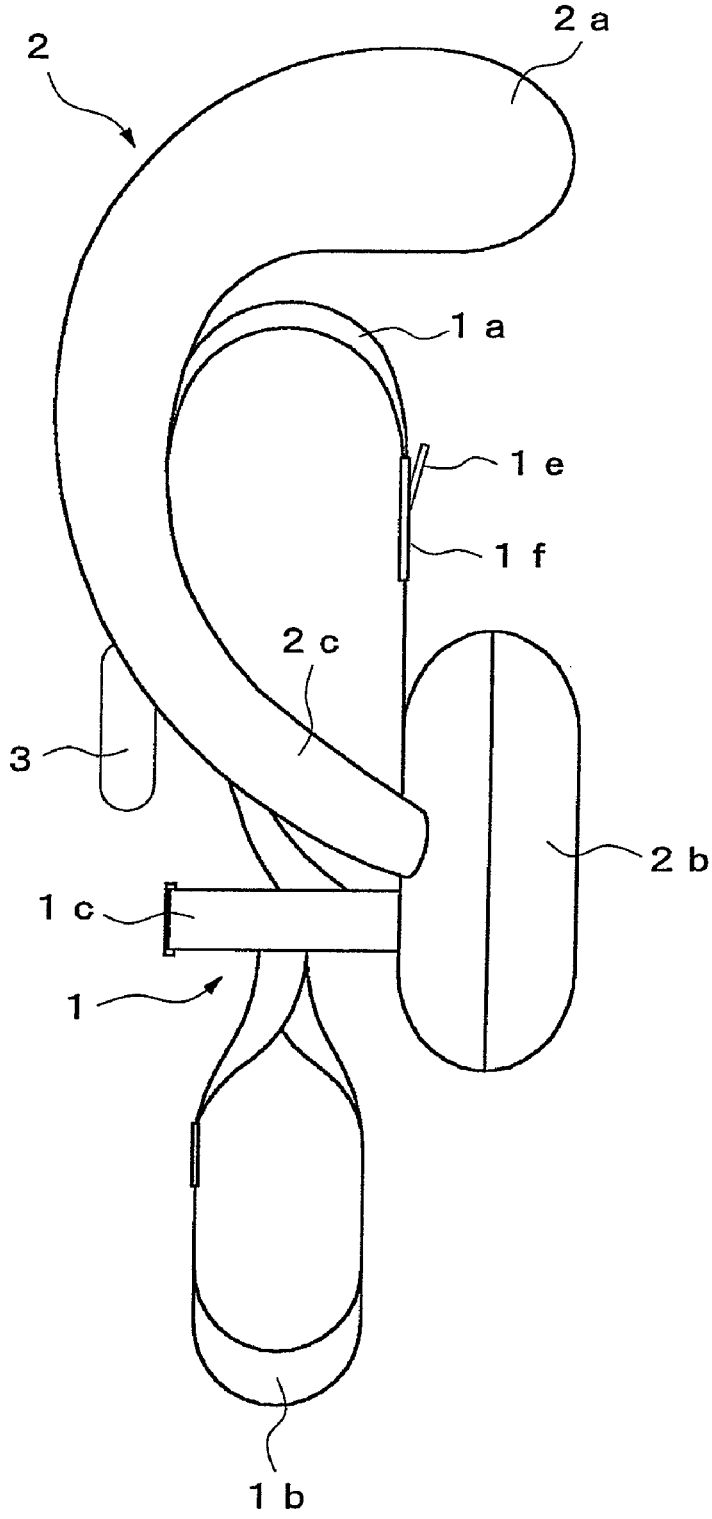
FIG. 6 is a right side view illustrating an inflated state of the air bag.
Figure 7:
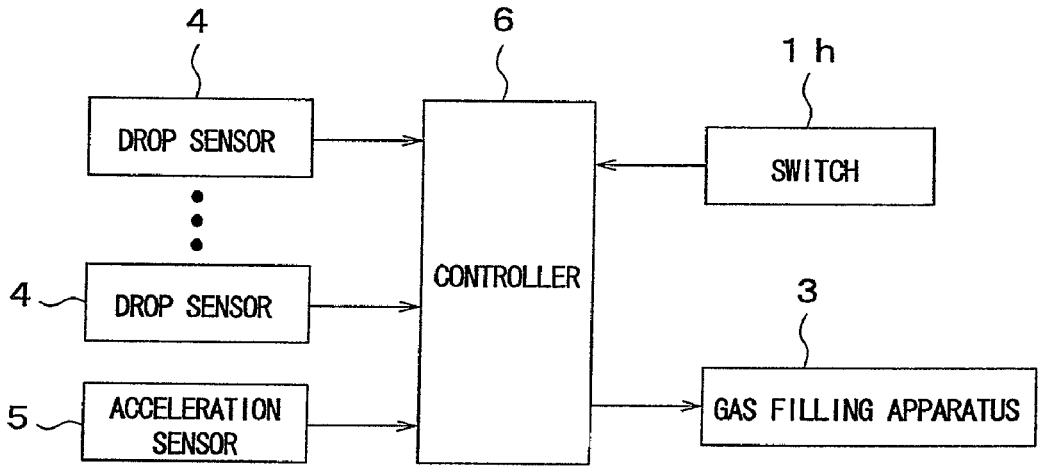
FIG. 7 is a block diagram illustrating a control system.

1 . . . mounting body, 1*a* . . . shoulder part belt, 1*b* . . . thigh part belt, 1*c* . . . waist part belt, 1*e* . . . connection ring, 1*g* . . . front buckle, 1*h* . . . switch, 2 . . . air bag, 2*a* . . . first air bag body, 2*b* . . . second air bag body, 3 . . . gas filling apparatus, 4 . . . drop sensor, 5 . . . acceleration sensor and 6 . . . controller.

BEST MODE FOR CARRYING OUT THE INVENTION

FIG. 1 to FIG. 15 illustrate an embodiment of the present invention.

A harness type safety belt of the present embodiment is configured by a mounting body 1 mounted on the body of a user; an air bag 2 provided in the mounting body 1; a gas filling apparatus 3 which inflates the air bag 2; a plurality of drop sensors 4 which detect dropping of the body of the user; an acceleration sensor 5 which detects an occurrence of upward and downward acceleration to the body of the user; and a controller 6 which activates the gas filling apparatus 3 based on detection signals of each of the drop sensors 4 and the acceleration sensor 5. The drop sensors 4 and the acceleration sensor 5 constitute fall detection means.

The mounting body 1 includes a pair of shoulder part belts 1*a* which intersect on a back of the body of a user and are hung on both shoulders, a pair of thigh part belts 1*b* into which both thigh parts of the body of the user are inserted respectively, a waist part belt 1*c* mounted on a waist part of the body of the user and a chest part belt 1*d* positioned in front of a chest part of the body of the user. A connection ring 1*e* connectable to a rope not illustrated in the drawing is attached to an intersecting part of the shoulder part belts 1*a*. One ends of the shoulder part belts 1*a* are connected to side parts of the waist part belt 1*c*, respectively. The other ends thereof intersect in the back side and are respectively connected to the side parts of the waist part belt 1*c*. In addition, a back buckle 1*f* is attached to the intersecting part of the shoulder part belts 1*a*. The thigh part belts 1*b* are formed annular and top parts thereof are connected to the side parts of the waist part belt 1*c*, respectively. The waist part belt 1*c* includes a front buckle 1*g* with a known structure which can detachably combine both ends of the waist part belt in the front. A switch 1*h* put ON and OFF in conjunction with combination and cancel of combination of the front buckle 1*g* is provided inside the front buckle 1*g*. The chest part belt 1*d* is arranged upward from the waist part belt 1*c* and both ends thereof are connected to front sides of the shoulder part belts 1*a*, respectively.

The air bag 2 is made of highly air-tight and durable fabric such as Vectran (wholly aromatic polyester), for example. Fabric made of that material is sewn or heat-sealed to form the shape of an air bag. That is, the air bag 2 includes a first air bag part 2*a* formed so as to extend toward the front from a back head part of the body of the user via the both shoulders and a second air bag part 2*b* formed so as to cover a back side of the waist part of the body of the user. The second air bag parts 2*a* and 2*b* communicate to each other via a communication part 2*c* extending over a side part of the second air bag part 2*b* from one end of the first air bag part 2*a*. That is, the air bag 2 is formed so that a part corresponding with the back of the body of the user in the first air bag part 2*a* is positioned upward from the connection ring 1*e* and a part corresponding with the back of the body of the user in the second air bag part 2*b* is positioned downward from the connection ring 1*e*.

The gas filling apparatus 3 with a known configuration discharges compressed fluid encapsulated in a cylinder, for example, by explosion of gun powder and is connected to the communication part 2*c* of the air bag 2.

Each drop sensor 4 includes a cylindrically formed container 10, a fixed contact point 11 provided on an inner circumferential plane of the container 10, a plurality of movable contact points 12 being elastic and deformable and arranged to be spaced apart from one another in the circumferential direction inside the container 10, and an inertia body 13 elastically deforming the movable contact points 12 to come into contact with the fixed contact point 11.

The container 10 is made of a cylindrical electroconductive metal member provided with a bottom. An opening in one end thereof is sealed with an electroconductive lid plate 10*a*. In addition, a rod-like electroconductive terminal 10*b* is attached to the lid plate 10*a* so as to pierce the container 10 through to the interior through an insulating member 10*c*.

The fixed contact point 11 is formed by the inner circumferential plane of the container 10. A plurality of protruding parts 11*a* formed by partially protruding inside the container 10 are provided on its circumferential plane, being spaced apart from one another in the circumferential direction so as to extend in an axial center direction of the container 10.

The movable contact points 12 are made of electroconductive metal film plates extending in the axial center direction of the container 10 and are arranged to be spaced apart from one another in the circumferential direction of the container 10. One end side of each movable contact point 12 is sandwiched and fixed between an electroconductive metal plate 12*a* welded and fixed to an end plane of the electroconductive terminal 10*b* and an insulating member 12*b* made of synthetic resin arranged on the side of the lid plate 10*a* and is electrically conductive to the electroconductive terminal 10*b*.

The inertia body 13 is a metal spherical body housed inside the container 10 and is arranged inside and surrounded by the movable contact points 12 in a freely movable manner.

In each drop sensor 4, in such a state of being influenced by gravity in a direction perpendicular to the axial center of the container 10 (in a radial direction of the container 10), the movable contact points 12 downward from the inertia body 13 are elastically deformed by the weight of the inertia body 13 and pressed to the fixed contact point 11 so as to be electrically conductive to the fixed contact point 11. In addition, when each drop sensor 4 enters a drop state, apparent weight of the inertia body 13 is reduced. Therefore, the movable contact points 12 bent toward the fixed contact point 11 by the inertia body 13 pushes the inertia body 13 back toward the center of the container 10 and depart from the fixed contact point 11 to cancel the conductive state to the fixed contact point 11. That is, the drop sensors 4 configure always-ON sensors.

In addition, a plate-like insulating member 10*d* made of synthetic resin is attached to the bottom plane of the other end of the container 10. In the case where the movable contact points 12 depart from the fixed contact point 11 so that the inertia body 13 contacts the bottom plane of the container 10, the insulating member 10*d* does not allow the movable contact points 12 to be electrically conductive to the fixed contact point 11 through the inertia body 13.

The movable contact points 12 are respectively arranged between the protruding parts 11*a* of the fixed contact point 11. In the case where the inertia body 13 contacts the movable contact points 12, the contact between the inertia body 13 and the protruding parts 11*a* forms no gap so that the movable contact points 12 are not directly nipped between the inertia body 13 and the fixed contact point 11. Thereby, also in the case of spreading material that is apt to deform to form the movable contact points 12, the movable contact points 12 can be prevented from deformation due to the spread. In addition, the insulating member 12*b* on the side of the lid plate 10*a* is provided with a plurality of protrusions 12*c* protruding toward the bottom plane side of the container 10 which are arranged to be spaced apart from one another in the circumferential direction. In the case where the inertia body 13 moves to one end sides of the movable contact points 12, the inertia body 13 does not directly contact the one end sides of the movable contact points 12 by abutment of the inertia body 13 and the protrusions 12*c*. Thereby, an enormous amount of stress generated by pressure of the inertia body 13 does not occur in the one end sides of the movable contact points 12, and plastic deformation and changes in property in the movable contact points 12 can be prevented.

The acceleration sensor 5 is shaped the same as the drop sensors 4. Therefore, like reference characters will designate the same components as the drop sensors 4. In contrast to that the movable contact points 12 of a drop sensor 4 are formed so as to contact the fixed contact point 11 due to the weight of the inertia body 13, the movable contact points 12 of the acceleration sensor 5 are higher than the movable contact points 12 of the drop sensor 4 in restoration nature and do not contact the fixed contact point 11 only with the weight of the inertia body 13. That is, the movable contact points 12 of the acceleration sensor 5 contact the fixed contact point 11 in the case where apparent gravity applied to the inertia body 13 gets larger than a predetermined amount (1.5 G, for example) accelerated in the direction of gravity. Thereby, the drop sensors 4 configure always-OFF sensors.

The controller 6 is configured by a microcomputer and is connected to the switch 1*h*, the gas filling apparatus 3, each drop sensor 4 and the acceleration sensor 5. In addition, the controller 6 has a timer function.

Figure 8:
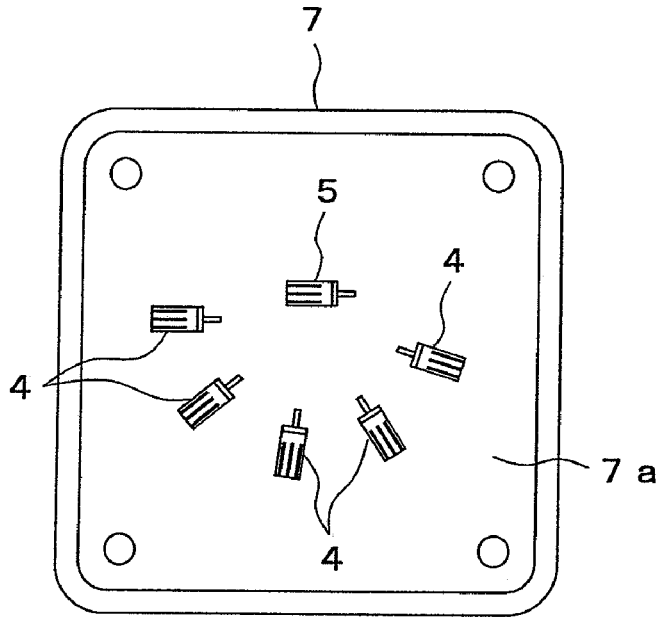
FIG. 8 is a front view illustrating the interior of a sensor unit.
Figure 9:
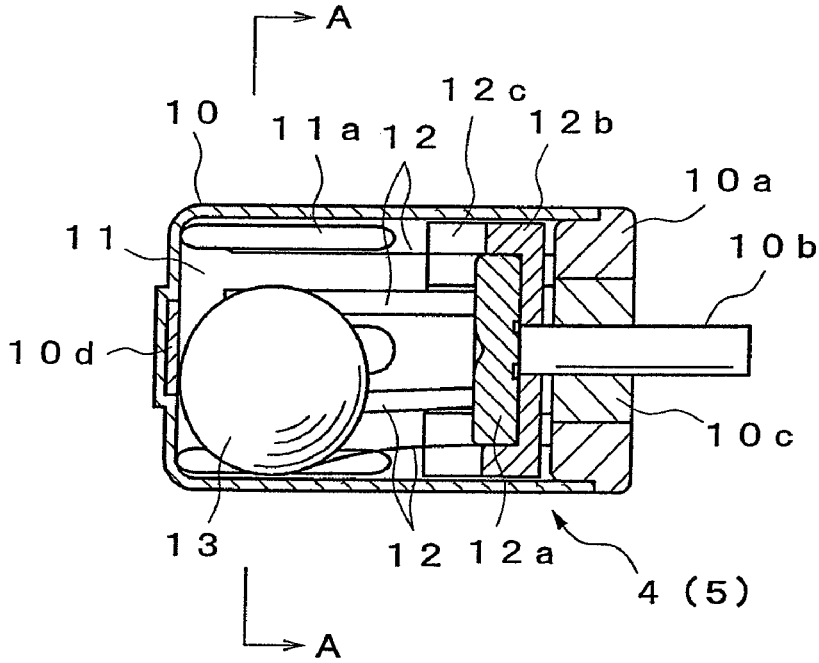
FIG. 9 is side section of a drop sensor and an acceleration sensor.
Figure 10:
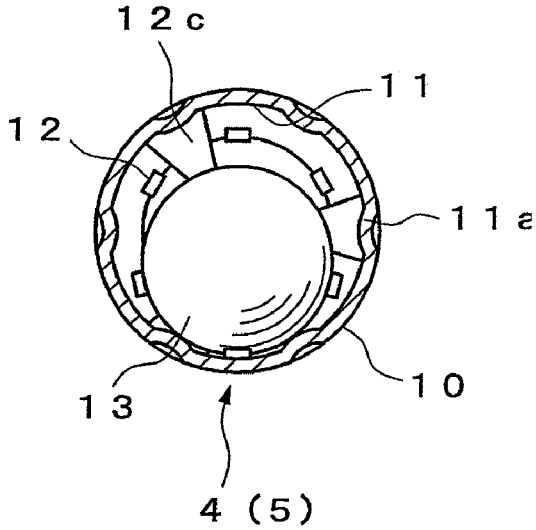
FIG. 10 is a section in the direction of A-A arrows in FIG. 9.

In addition, each drop sensor 4 and the acceleration sensor 5 are attached to a substrate 7*a* inside a center unit 7 as illustrated in FIG. 8. The center unit 7 is housed in a housing part 1*i* on the side of a front plane provided in the torso part belt 1*a* of the mounting body 1 together with the controller 6.

In that case, the drop sensors 4 are arranged on the same approximately vertical plane (on the substrate 7*a*) so that the axial centers of containers 10 make a predetermined inclination angle one another. In order that the drop sensor 4 is in an ON state, that is, the movable contact points 12 are bent to contact the fixed contact point 11 due to the weight of the inertia body 13, the axial center of the container 10 is required to be present inside a predetermined angle range to the horizontal plane. For example, the axial center of the container 10 is inclined within a predetermined angle range, the inertia body 13 contacts the bottom plane and the like of the container 10 so that its own weight will not be applied enough in the direction of bending the movable contact points 12. Therefore, a slight gravity change due to upward and downward movements cancels contacts between the movable contact points 12 and the fixed contact point 11 and much larger inclination will cancel contacts between the movable contact points 12 and the fixed contact point 11 regardless of the level of gravity. Therefore, each drop sensor 4 is arranged to form a radial shape with the angles being changed within a predetermined inclination angle so that the ranges which do not give rise to the state as described above overlap each other. In that case, the drop sensors 4 have a uniform property in the circumference direction of the container 10. Therefore, not only in the case where the substrate 7*a* of the center unit 7 is inclined along the approximately vertical flat plane but also in the case where the substrate 7*a* of the center unit 7 is inclined obliquely off the vertical plane, at least one drop sensor 4 will be put ON. In addition, when the center unit 7 enters a drop state, all the drop sensors 4 will be put OFF.

On the other hand, the acceleration sensor 5 is arranged so that the axial center of the container 10 is approximately horizontal. That is, the acceleration sensor 5 detects upward acceleration in such a case where the user jumps or jumps over a slight step, and does not have to detect occurrence of acceleration in the directions other than the upward acceleration. However, the acceleration sensor 5 does not necessarily have to be one. Therefore two or more acceleration sensors 5 can be provided or a part thereof can be caused to incline slightly.

Figure 12:
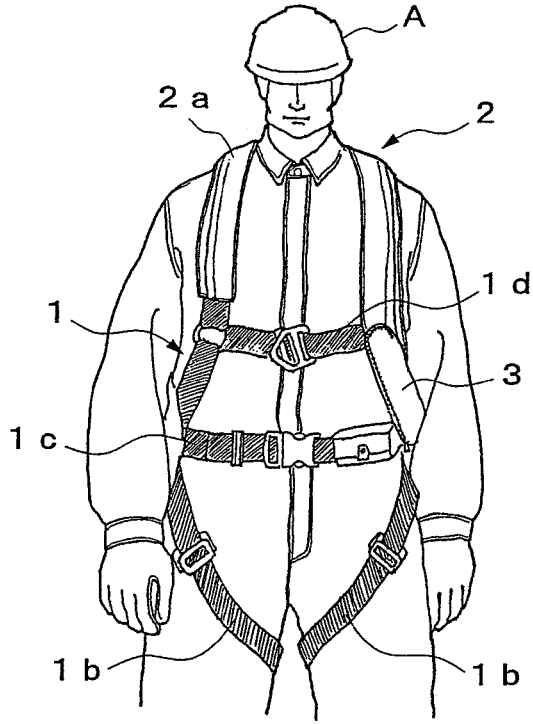
FIG. 12 is a front view illustrating a contraction state of the air bag worn by a user.
Figure 13:
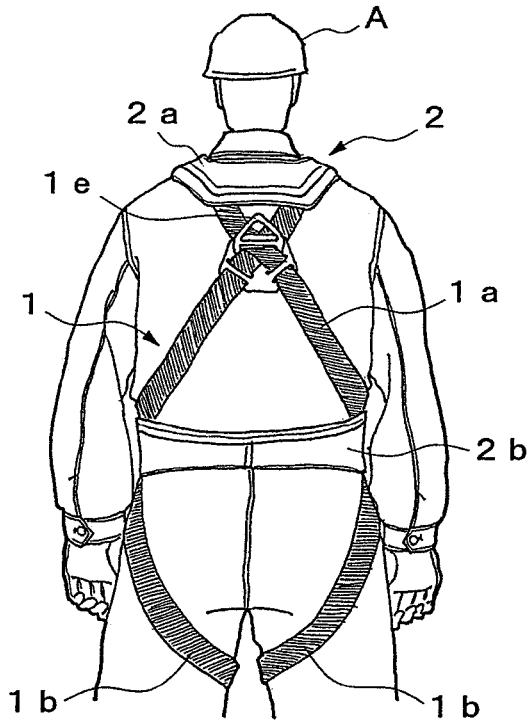
FIG. 13 is a rear view illustrating a contraction state of the air bag worn by a user.
Figure 14:
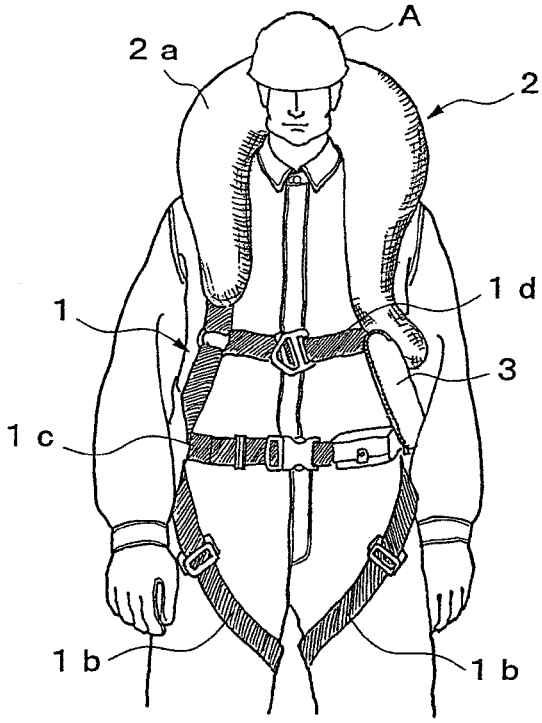
FIG. 14 is a front view illustrating an inflated state of the air bag worn by a user.
Figure 15:
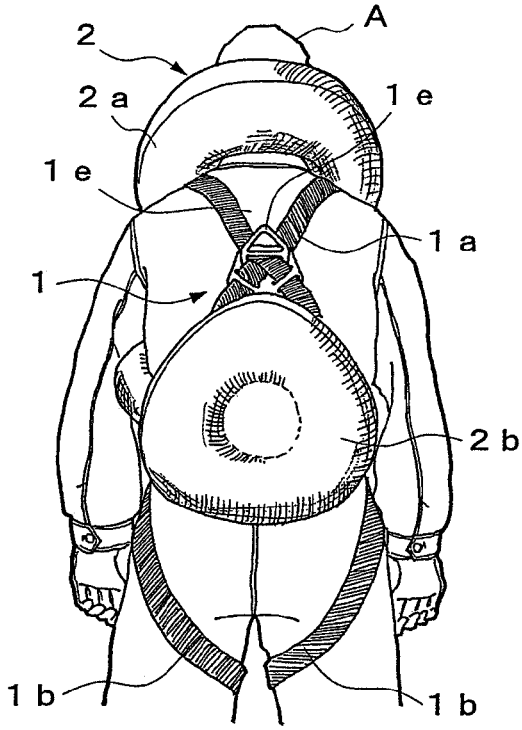
FIG. 15 is a rear view illustrating an inflated state of the air bag worn by a user.

The harness type safety belt configured as described above is used by a user A wearing the mounting body 1 on the body as illustrated in FIG. 12 and FIG. 13. That is, the user inserts both of the thigh parts into the respective thigh part belts 1*c*, hangs the shoulder part belts 1*a* onto the both shoulders and combines the front buckle 1*f* with the waist part belt 1*b*. Thereby the mounting body 1 is mounted on the body of the user. In addition, a rope not illustrated in the drawing is connected to the connection ring 1*e*. By connecting a hook of the rope to a life line of the work site, the user is suspended by the rope when the user accidentally falls. At that occasion, the body of the user is supported by not only the waist part belt 1*b* but also the shoulder part belts 1*a* and the thigh part belts 1*c*. Therefore a tension applied from the rope to the body of the user can be dispersed to each of the belts 1*a*, 1*b* and 1*c* and the body of the user is stably supported.

Figure 11:
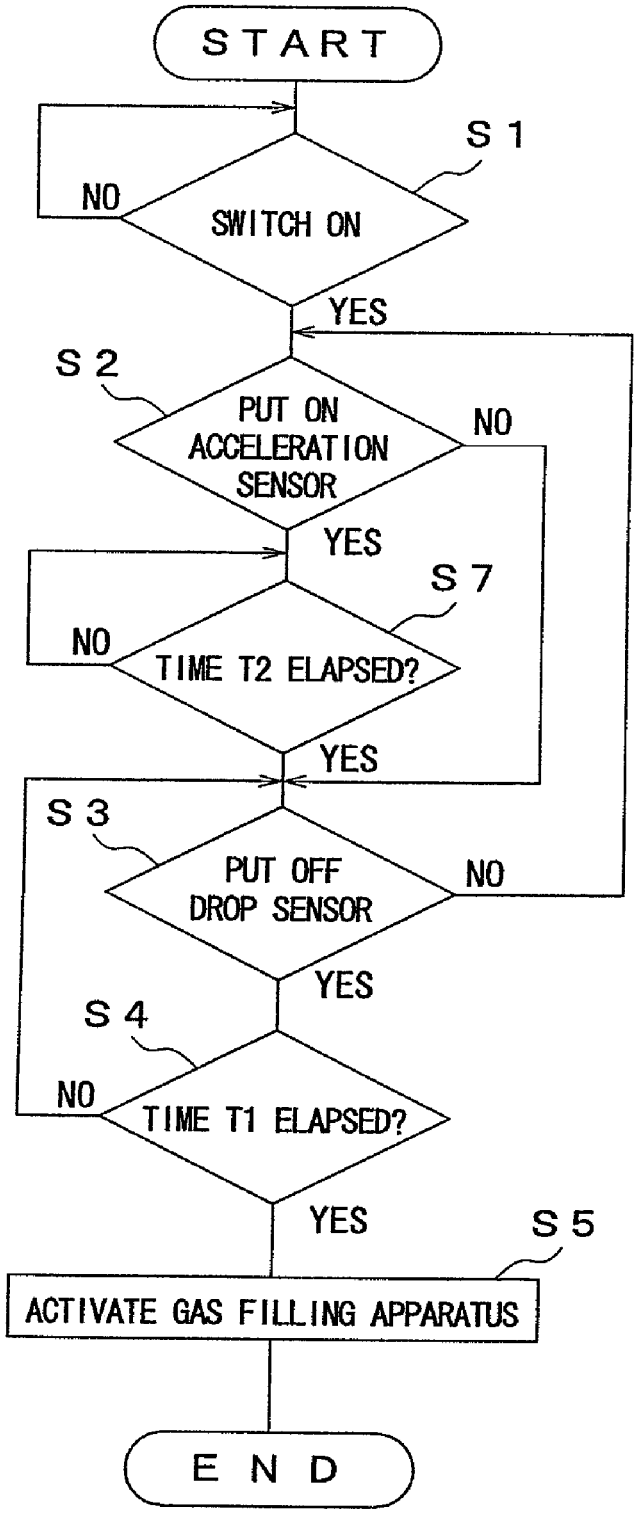
FIG. 11 is a flow chart illustrating operations of a controller.

Next, operations of the above described safety belt will be described according to operations of the controller 6 based on the flow chart in FIG. 11.

At first, the mounting body 1 is mounted on a user. When the switch 1*h* of the mounting body 1 is put ON (S1), the following program will start. That is, in the case where no upward acceleration is taking place on the user A and the acceleration sensor 5 is not put ON (S2), the user A accidentally falls from an elevated work site, for example and that falling state puts OFF all the drop sensors 4 (S3). The OFF state of each drop sensor 4 continues for not less than a predetermined time period T1 (for example, 0.4 seconds) (S4). Then the gas filling apparatus 3 is activated (S5). Thereby, the air bag 2 is inflated. The air bag parts 2*a* and 2*b* of the air bag 2 absorb a dropping impact to the user A.

In addition, in the case the user A jumps or jumps over a slight step and the like, upward acceleration other than a fall takes place to put ON the acceleration sensor 5 (S2). Then after the elapse of not less than a predetermined time period T2 (for example, 0.4 seconds) (S6), ON and OFF of each drop sensor 4 are determined (S3). For example, in the case where the user A jumps, even if the drop sensors 4 are put OFF during jumping, the user normally lands at the point of time when the time period T2 elapsed. Then the drop sensors 4 return to the ON state. The drop sensors 4 will not be determined to be OFF at step S3. Consequently the gas filling apparatus 3 will not be activated. In addition, the user A accidentally falls to put OFF the drop sensors 4 and put ON the acceleration sensor 5 (S2). Then the OFF state of each drop sensor 4 continues even after the predetermined time period T2 (S6 and S3) elapsed. Therefore, after the predetermined time period T1 elapsed (S4), the gas filling apparatus is activated (S5).

Thus, in the harness type safety belt of the present embodiment, in such a case that the user A fails to apply the hook of the rope to the life line and the user A falls from an elevated position, the air bag 2 provided in the mounting body 1 is inflated. Therefore, the air bag 2 can absorb a dropping shock and the dropping impact applied to the user A can be reduced. In addition, in the case where the user A falls with the hook of the rope being connected to the life line, the user A is suspended by the rope. The body of the user A is supported by not only the waist part belt 1*b* but also the shoulder part belts 1*a* and the thigh part belts 1*c*. Therefore a tension applied from the rope to the body of the user can be dispersed to each of the belts 1*a*, 1*b* and 1*c* and the body of the user can be stably supported.

In addition, the air bag 2 is formed by the first air bag part 2*a* with a part corresponding with the back of the body of the user being positioned upward from the connection ring 1*e* and the second air bag part 2*b* with a part corresponding with the back of the body of the user being positioned downward from the connection ring 1*e*. Therefore, there is no mutual interference between the air bag parts 2*a* and 2*b* and the connection ring 1*e*, and the rope can be always connectable to the connection ring 1*e* without any trouble.

In that case, the first air bag part 2*a* is formed so as to extend toward the front from the back head part of the body of the user via the both shoulders and the second air bag part 2*b* is formed so as to cover the waist part of the body of the user. The air bag 2 can absorb at least a dropping shock to the back head part and the waist part of the body of the user and can effectively absorb the shock to the body of the user.

In addition, the harness type safety belt includes the plurality of drop sensors 4 which are switched from an ON state to an OFF state when the apparent gravity taking place in the inertia body 13 decreases; and the acceleration sensor 5 which is switched from an OFF state to an ON state when the apparent gravity taking place in the inertia body 13 increases. Except the time period up to the elapse of the predetermined time period T2 after the acceleration sensor 5 is put ON by acceleration due to up and down movements other than a fall in such a case that the user jumps or jumps over a step, such a state that all the drop sensors 4 are detected being in the OFF states due to a fall of the user continues for not less than the predetermined time period T1. Then the air bag 2 is inflated. Thereby, malfunctions other than an occasion of a fall can be firmly prevented and improvement in reliability can be attained.

In that case, each drop sensor 4 and the acceleration sensor 5 are provided in the positions corresponding with the waist part of the body of the user. Relatively sudden movements are less likely to occur in the vicinity of the waist part in the body of the user. Therefore, malfunctions of each drop sensor 4 and the acceleration sensor 5 can be reduced further.

In addition, the harness type safety belt includes the front buckle 1*g* for detachably combining with the torso part belt 1*a* of the mounting body 1 in front of the body of the user and the switch 1*h* for bringing the controller 6 into an operable state when the front buckle 1*g* is combined. Therefore, mounting of the mounting body 1 concurrently enables the controller 6 to enter an operable state. Thereby unintentional default in operation can be firmly prevented.

The invention claimed is:

1. A harness type safety belt comprising a pair of shoulder part belts which intersect on a back of the body of a user and are hung on both shoulders; a pair of annular thigh part belts into which both thigh parts of the body of the user are inserted respectively; a waist part belt mounted on a waist part of the body of the user; and a connection part capable of connecting a rope to an intersecting part of the shoulder part belts, comprising:

an air bag provided in a predetermined position of said pair of shoulder part belts, said pair of annular thigh part belts and said waist part belt;

inflation means for inflating the air bag;

fall detection means for detecting a fall of the body of the user; and control means for inflating the air bag when the fall detection means detects a fall of the body of the user, the fall detection means is configured by at least one drop sensor which detects a dropping state of the body of the user; and a plurality of acceleration sensors which detects an occurrence of applying to the body of the user acceleration of not less than a predetermined level larger than acceleration due to gravity; and the control means is configured to inflate the air bag when such a state that the dropping state is detected by the drop sensor continues for not less than a predetermined time period except a time period up to the elapse of the predetermined time period after the acceleration sensor detects an occurrence of acceleration of not less than the predetermined level, wherein:

each of the drop sensors is configured by a cylindrically formed container; a fixed contact point provided in an inner circumferential plane of the container; a plurality of movable contact points being elastic and deformable and arranged to be spaced apart from one another in a circumferential direction inside the container; and an inertia body elastically deforming, with its own weight, the movable contact points to come into contact with the fixed contact point, and drop sensors are arranged on the same approximately vertical plane so that axial centers of containers make a predetermined inclination angle one another;

the acceleration sensor is configured by a cylindrically formed container; a fixed contact point provided in an inner circumferential plane of the container; a plurality of movable contact points being elastic and deformable and arranged to be spaced apart from one another in a circumferential direction inside the container; and an inertia body elastically deforming the movable contact points to come into contact with the fixed contact point at an occurrence of acceleration of not less than a predetermined level larger than acceleration due to gravity, and is arranged so that an axial center of the container is approximately parallel to a horizontal direction;

the control means inflates the air bag when such a state that the movable contact points and the fixed contact points of all the drop sensors are detected being non-conductive continues for not less than a predetermined time period except a time period up to the elapse of the predetermined time period after the movable contact points and the fixed contact point of the acceleration sensor are detected being conductive.

2. The harness type safety belt according to claim 1, wherein:

the air bag is formed by a first air bag part with a part corresponding with the back of the body of the user being positioned upward from the connection part; and a second air bag part with a part corresponding with the back of the body of the user being positioned downward from the connection part.

3. The harness type safety belt according to claim 2, wherein:

the first air bag part is formed so as to extend toward the front from a back head part of the body of the user via the both shoulders; and the second air bag part is formed so as to cover the waist part of the body of the user.

4. The harness type safety belt according to claim 1, wherein:

the fall detection means is configured by at least one drop sensor which detects a dropping state of the body of the user; and a plurality of acceleration sensors which detects an occurrence of applying to the body of the user acceleration of not less than a predetermined level larger than acceleration due to gravity; and the control means is configured to inflate the air bag when such a state that the dropping state is detected by the drop sensor continues for not less than a predetermined time period except a time period up to the elapse of the predetermined time period after the acceleration sensor detects an occurrence of acceleration of not less than the predetermined level.

5. A harness type safety belt comprising a pair of shoulder part belts which intersect on a back of the body of a user and are hung on both shoulders; a pair of annular thigh part belts into which both thigh parts of the body of the user are inserted respectively; a waist part belt mounted on a waist part of the body of the user; and a connection part capable of connecting a rope to an intersecting part of the shoulder part belts, comprising:

an air bag provided in a predetermined position of said pair of shoulder part belts, said pair of annular thigh part belts and said waist part belt;

inflation means for inflating the air bag;

fall detection means for detecting a fall of the body of the user; and control means for inflating the air bag when the fall detection means detects a fall of the body of the user, the fall detection means is configured by at least one drop sensor which detects a dropping state of the body of the user; and a plurality of acceleration sensors which detects an occurrence of applying to the body of the user acceleration of not less than a predetermined level larger than acceleration due to gravity; and the control means is configured to inflate the air bag when such a state that the dropping state is detected by the drop sensor continues for not less than a predetermined time period except a time period up to the elapse of the predetermined time period after the acceleration sensor detects an occurrence of acceleration of not less than the predetermined level, wherein:

each drop sensor and the acceleration sensor are provided in positions corresponding with the waist part of the body of the user.

6. A harness type safety belt comprising a pair of shoulder part belts which intersect on a back of the body of a user and are hung on both shoulders; a pair of annular thigh part belts into which both thigh parts of the body of the user are inserted respectively; a waist part belt mounted on a waist part of the body of the user; and a connection part capable of connecting a rope to an intersecting part of the shoulder part belts, comprising:

an air bag provided in a predetermined position of said pair of shoulder part belts, said pair of annular thigh part belts and said waist part belt;

inflation means for inflating the air bag;

fall detection means for detecting a fall of the body of the user; and control means for inflating the air bag when the fall detection means detects a fall of the body of the user, further comprising:

a combination member for detachably combining with a waist part belt in front of the body of the user; and a switch for bringing the control means into an operable state when the combination member is combined.

7. The harness type safety belt according to claim 5, wherein:

the air bag is formed by a first air bag part with a part corresponding with the back of the body of the user being positioned upward from the connection part; and a second air bag part with a part corresponding with the back of the body of the user being positioned downward from the connection part.

8. The harness type safety belt according to claim 7, wherein:

the first air bag part is formed so as to extend toward the front from a back head part of the body of the user via the both shoulders; and the second air bag part is formed so as to cover the waist part of the body of the user.

9. The harness type safety belt according to claim 6, wherein:

the air bag is formed by a first air bag part with a part corresponding with the back of the body of the user being positioned upward from the connection part; and a second air bag part with a part corresponding with the back of the body of the user being positioned downward from the connection part.

10. The harness type safety belt according to claim 9, wherein:

the first air bag part is formed so as to extend toward the front from a back head part of the body of the user via the both shoulders; and the second air bag part is formed so as to cover the waist part of the body of the user.

11. The harness type safety belt according to claim 5, wherein:

the fall detection means is configured by at least one drop sensor which detects a dropping state of the body of the user; and a plurality of acceleration sensors which detects an occurrence of applying to the body of the user acceleration of not less than a predetermined level larger than acceleration due to gravity; and the control means is configured to inflate the air bag when such a state that the dropping state is detected by the drop sensor continues for not less than a predetermined time period except a time period up to the elapse of the predetermined time period after the acceleration sensor detects an occurrence of acceleration of not less than the predetermined level.

12. The harness type safety belt according to claim 5 wherein:

the fall detection means is configured by at least one drop sensor which detects a dropping state of the body of the user; and a plurality of acceleration sensors which detects an occurrence of applying to the body of the user acceleration of not less than a predetermined level larger than acceleration due to gravity; and the control means is configured to inflate the air bag when such a state that the dropping state is detected by the drop sensor continues for not less than a predetermined time period except a time period up to the elapse of the predetermined time period after the acceleration sensor detects an occurrence of acceleration of not less than the predetermined level.

* * * * *